US010473116B2

(12) United States Patent
Stevens

(10) Patent No.: US 10,473,116 B2
(45) Date of Patent: Nov. 12, 2019

(54) ENGINE COOLING FAN CASING SHROUD WITH UNOBSTRUCTED OUTLET

(71) Applicant: Robert Bosch GmbH, Stuttgart (DE)

(72) Inventor: William M. Stevens, Maynard, MA (US)

(73) Assignee: Robert Bosch GmbH, Stuttgart (DE)

( * ) Notice: Subject to any disclaimer, the term of this patent is extended or adjusted under 35 U.S.C. 154(b) by 57 days.

(21) Appl. No.: 15/756,694

(22) PCT Filed: Dec. 8, 2016

(86) PCT No.: PCT/EP2016/080268
§ 371 (c)(1),
(2) Date: Mar. 1, 2018

(87) PCT Pub. No.: WO2017/137115
PCT Pub. Date: Aug. 17, 2017

(65) Prior Publication Data

US 2018/0245602 A1 Aug. 30, 2018

Related U.S. Application Data

(60) Provisional application No. 62/292,532, filed on Feb. 8, 2016.

(51) Int. Cl.
*F04D 29/52* (2006.01)
*F04D 29/54* (2006.01)
(Continued)

(52) U.S. Cl.
CPC ..... *F04D 29/526* (2013.01); *F04D 19/002* (2013.01); *F04D 25/08* (2013.01);
(Continued)

(58) Field of Classification Search
CPC .... F04D 29/526; F04D 29/667; F04D 29/326; F04D 29/164; F04D 25/08; F04D 19/002;
(Continued)

(56) References Cited

U.S. PATENT DOCUMENTS 4,548,548 A 10/1985 Gray, III
5,423,660 A 6/1995 Sortor
(Continued)

FOREIGN PATENT DOCUMENTS

EP 2517916 A1 10/2012

OTHER PUBLICATIONS

International Search Report and Written Opinion for Application No. PCT/EP2016/080268 dated Dec. 8, 2016, (8 pages).

*Primary Examiner* — Eldon T Brockman
(74) *Attorney, Agent, or Firm* — Michael Best & Friedrich LLP

(57) ABSTRACT

A shroud for an axial-flow fan includes an annular barrel. The barrel includes a cylindrical segment and a conical segment downstream of the cylindrical segment. The conical segment is angled radially inwardly from the cylindrical segment at an angle of between 15 and 35 degrees. The shroud also includes an annular outlet bell coupled to the conical segment at an apex defining a transition between the conical segment and the outlet bell. The outlet bell and barrel contain a plurality of leakage stators. A stator pedestal extends from a radially-inner surface of the outlet bell to a stator pedestal tip, and a depth (a) of the outlet bell measured from an end surface of the outlet bell to the apex is less than one-half a depth (b) measured from the end surface of the outlet bell to the stator tip in the direction of axial airflow through the fan shroud.

20 Claims, 4 Drawing Sheets

(51) Int. Cl.

| | |
|---|---|
| ***F04D 19/00*** | (2006.01) |
| ***F04D 25/08*** | (2006.01) |
| ***F04D 29/16*** | (2006.01) |
| ***F04D 29/32*** | (2006.01) |
| ***F04D 29/66*** | (2006.01) |
| *F04D 29/68* | (2006.01) |

(52) U.S. Cl.
CPC ..... *F04D 29/164* (2013.01); *F04D 29/326* (2013.01); *F04D 29/542* (2013.01); *F04D 29/547* (2013.01); *F04D 29/667* (2013.01); *F04D 29/685* (2013.01); *F05D 2250/52* (2013.01)

(58) Field of Classification Search
CPC .... F04D 29/547; F04D 29/542; F04D 29/685; F05D 2250/52
See application file for complete search history.

(56) References Cited

U.S. PATENT DOCUMENTS

| | | | | |
|---|---|---|---|---|
| 5,443,363 | A | 8/1995 | Cho | |
| 5,489,186 | A | 2/1996 | Yapp et al. | |
| 7,762,769 | B2 | 7/2010 | Stevens et al. | |
| 8,454,300 | B2 | 6/2013 | Stagg et al. | |
| 8,475,111 | B2 | 7/2013 | Stagg et al. | |
| 9,180,772 | B2 * | 11/2015 | Durello ..... | B60K 11/02 |
| 2003/0161728 | A1 | 8/2003 | Cho et al. | |
| 2006/0147304 | A1 | 7/2006 | Cho et al. | |
| 2007/0224044 | A1 | 9/2007 | Hong et al. | |
| 2010/0111667 | A1 | 5/2010 | Stagg et al. | |
| 2012/0275901 | A1 * | 11/2012 | Durello ..... | B60K 11/02 415/119 |
| 2015/0098817 | A1 | 4/2015 | Innocenti | |

* cited by examiner

ENGINE COOLING FAN CASING SHROUD WITH UNOBSTRUCTED OUTLET

RELATED APPLICATIONS

This application claims the benefit of U.S. Provisional Patent Application Ser. No. 62/292,532 filed Feb. 8, 2016, the entire content of which is hereby incorporated by reference herein.

FIELD OF THE INVENTION

The present invention relates to axial fans, and more particularly to automotive axial fan assemblies having shrouds.

BACKGROUND

Axial fan assemblies, when utilized in an automotive application, typically include a shroud, a motor coupled to the shroud, and an axial fan driven by the motor. The axial fan typically includes a band connecting the respective tips of the axial fan blades, thereby reinforcing the axial fan blades and allowing the tips of the blades to generate more pressure.

Axial fan assemblies utilized in automotive applications must operate with high efficiency and low noise. However, various constraints often complicate this design goal. Such constraints may include, for example, limited spacing between the axial fan and an upstream heat exchanger (i.e., "fan-to-core spacing"), aerodynamic blockage from engine components immediately downstream of the axial fan, a large ratio of the area of shroud coverage to the swept area of the axial fan blades (i.e., "area ratio"), and recirculation between the band of the axial fan and the shroud. Other constraints factoring into the design include the material mass and cost of the shroud, overall stiffness of the shroud, especially in the motor stators securing the motor and fan to the shroud, and the overall volume occupied in the motor vehicle.

Prior axial fan assemblies have attempted to account for all of the above constraints to varying degrees of success. One prior art axial fan assembly 10 is illustrated in FIGS. 1A and 1B, and is representative of the fan assembly shown in U.S. Pat. No. 4,548,548. Of particular interest are the two radial gaps "g" formed between the shroud barrel 14 and the fan band 18, as well as the simple outlet downstream of the fan, which is formed by the cylindrical barrel shape. These features comprise the most common geometry used in the market. They provide for low material cost and low molding complexity, but also lower fan efficiency and higher fan noise than other outlets. The structural braces 22 shown are typically needed to stiffen the shroud 26 around the barrel 14 in order to transfer load from the motor stators 30 to the shroud 26. Even with the braces 22 shown, this design may also require additional bracing.

Another prior art axial fan assembly 40 is illustrated in FIGS. 2A and 2B, and is representative of the fan assembly shown in U.S. Pat. No. 5,489,186. This arrangement includes leakage stators 44 that reduce airflow recirculating around the fan band 18 as well as to remove tangential velocity from the re-ingested flow. The outlet bell 48 reduces loss in the wake. These features often result in higher fan efficiency and/or lower fan noise than for the design of FIGS. 1A, 1B. The structure comprised of outlet bell 48, leakage stator 44 and barrel 52 provides significantly more stiffness than the FIGS. 1A, 1B design. This design, however, requires more material and occupies more volume in the vehicle. The efficiency and noise of this design may not be as good as the other designs when combined with tight blockage from other automotive components situated downstream of the fan's outlet. This is due to its relatively high "aerodynamic depth" d, which causes more restriction of the fan wake impinging on the downstream blockage.

Yet another prior art axial fan assembly 60 is illustrated in FIGS. 3A and 3B, and is representative of the fan assembly shown in U.S. Pat. No. 7,762,769. This arrangement is a further refinement of the design shown in FIGS. 2A, 2B. Running clearances between the fan band 18 and the outlet bell 64 are provided by a radial gap "g", rather than the axial gap. This allows smaller aerodynamic depth d. When in the presence of tight downstream blockage, this design results in less constriction in the fan wake impinging on the downstream blockage. Fan efficiency can thus be significantly higher than for the design of FIGS. 2A, 2B when compared in the presence of tighter downstream blockage. This outlet, however, tends to perform less effectively in the absence of downstream blockage, due to the radial gap "g" between the fan band 18 and the outlet bell 64. This design also provides stiffness comparable to the design of FIGS. 2A, 2B.

SUMMARY

This invention includes new design features for the shroud of an automotive engine cooling fan assembly. The new features include the shape of the shroud's "outlet," "barrel," and "stator pedestals." The improved design reduces the shroud's material cost as well as the volume it occupies in the motor vehicle without reducing stiffness in the connection between the motor stators and the shroud. It does this while providing for high fan efficiency and low fan noise under a wide range of conditions.

In one embodiment, the invention provides a fan shroud for an axial-flow fan. The shroud includes a motor mount, a plurality of motor stators coupling the motor mount to a radially outer portion of the shroud, and an annular barrel extending axially away from the radially outer portion of the shroud. The annular barrel includes a cylindrical segment and a conical segment downstream of the cylindrical segment. The conical segment is angled radially inwardly from the cylindrical segment at an angle of between 15 degrees and 35 degrees. The shroud also includes an annular outlet bell coupled to the conical segment at an apex defining a transition between the conical segment and the outlet bell. The outlet bell and barrel contain a plurality of circumferentially-spaced leakage stators therein for disrupting or decreasing a tangential component of airflow within the outlet bell and barrel. Each of the plurality of motor stators is coupled to the outlet bell by a stator pedestal extending from a radially-inner surface of the outlet bell to a stator pedestal tip, and a depth (a) of the outlet bell measured from an end surface of the outlet bell to the apex in a direction of axial airflow through the fan shroud is less than one-half a depth (b) measured from the end surface of the outlet bell to the stator tip in the direction of axial airflow through the fan shroud.

In another embodiment, the invention provides an axial fan assembly having an axial fan including a hub, a plurality of blades extending outwardly from the hub, and a band interconnecting tip portions of the plurality of the blades. The band includes a radially-inner surface, a radially-outer surface, and an end surface adjacent to and extending between the radially-inner surface and the radially-outer surface. The axial fan assembly further includes a motor drivingly connected to the axial fan and fan shroud. The shroud includes a motor mount, a plurality of motor stators coupling the motor mount to a radially outer portion of the shroud, and an annular barrel extending axially away from the radially outer portion of the shroud. The annular barrel includes a cylindrical segment and a conical segment downstream of the cylindrical segment. The conical segment is angled radially inwardly from the cylindrical segment at an angle of between 15 degrees and 35 degrees. The shroud also includes an annular outlet bell coupled to the conical segment at an apex defining a transition between the conical segment and the outlet bell. The outlet bell and barrel contain a plurality of circumferentially-spaced leakage stators therein for disrupting or decreasing a tangential component of airflow within the outlet bell and barrel. Each of the plurality of motor stators is coupled to the outlet bell by a stator pedestal extending from a radially-inner surface of the outlet bell to a stator pedestal tip, and a depth (a) of the outlet bell measured from an end surface of the outlet bell to the apex in a direction of axial airflow through the fan shroud is less than one-half a depth (b) measured from the end surface of the outlet bell to the stator tip in the direction of axial airflow through the fan shroud. An axial gap G1 is provided between the end surface of the band and the end surface of the outlet bell, and the end surface of the band and the end surface of the outlet bell are aligned in a radial direction.

Other features and aspects of the invention will become apparent by consideration of the following detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

DETAILED DESCRIPTION

Figure 1A:
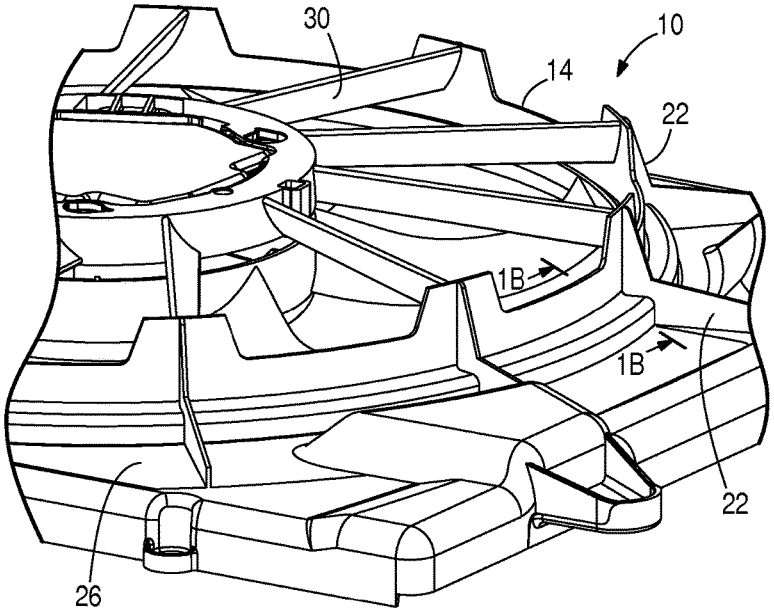
FIG. 1A PRIOR ART
FIG. 1A is a partial perspective view of a prior art axial fan assembly, illustrating a shroud, a motor coupled to the shroud, and an axial fan driven by the motor.
Figure 1B:
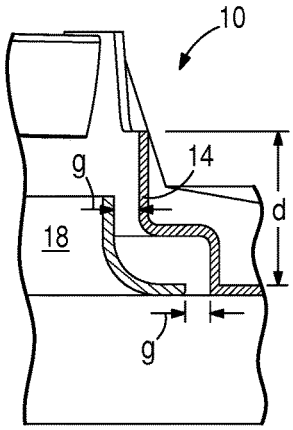
FIG. 1B PRIOR ART
FIG. 1B is a partial section view of the shroud and fan band of FIG. 1A.
Figure 2A:
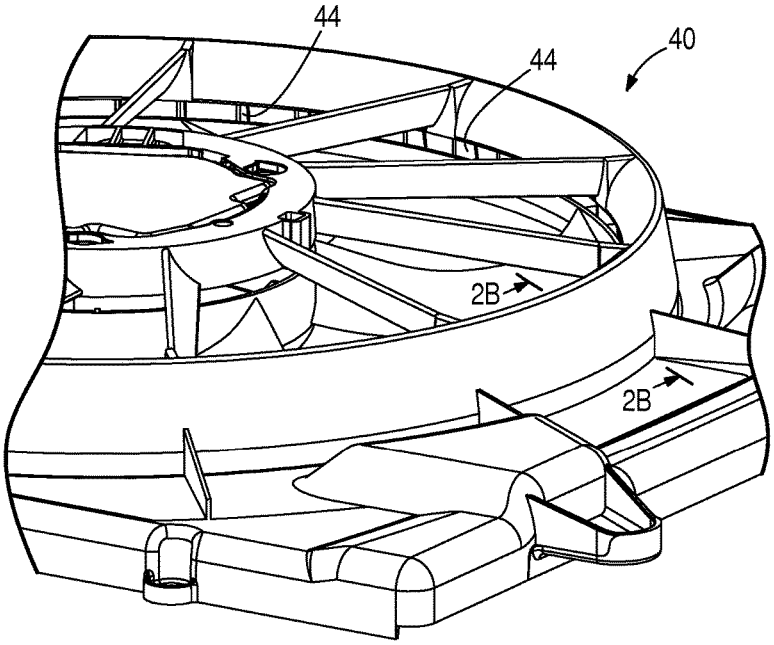
FIG. 2A PRIOR ART
FIG. 2A is a partial perspective view of another prior art axial fan assembly, illustrating a shroud, a motor coupled to the shroud, and an axial fan driven by the motor.
Figure 2B:
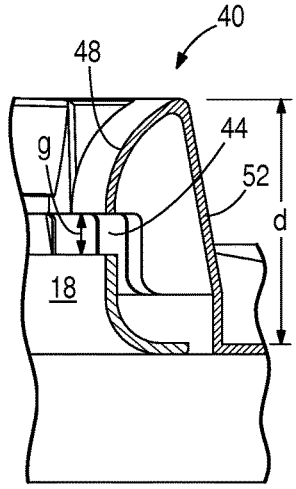
FIG. 2B PRIOR ART
FIG. 2B is a partial section view of the shroud and fan band of FIG. 2A.
Figure 3A:
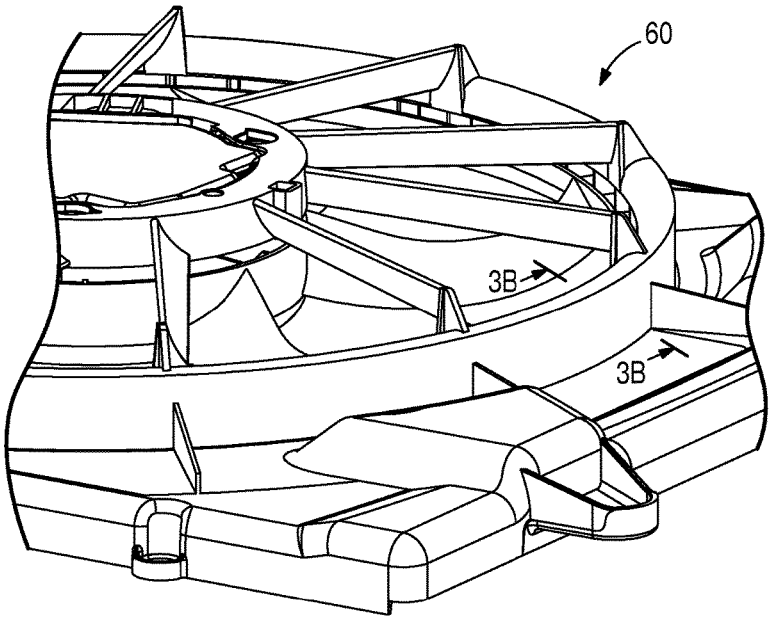
FIG. 3A PRIOR ART
FIG. 3A is a partial perspective view of another prior art axial fan assembly, illustrating a shroud, a motor coupled to the shroud, and an axial fan driven by the motor.
Figure 3B:
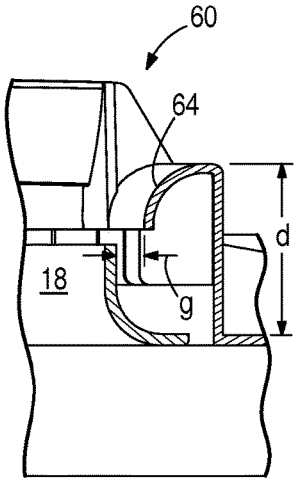
FIG. 3B PRIOR ART
FIG. 3B is a partial section view of the shroud and fan band of FIG. 3A.
Figure 4:
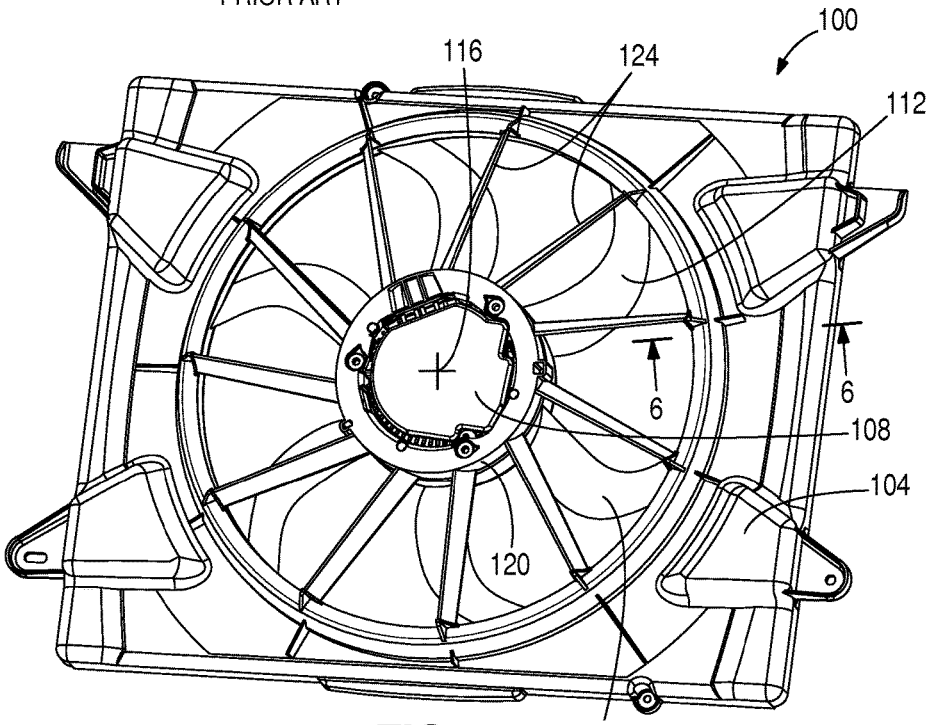
FIG. 4 is a perspective view of an axial fan assembly embodying the present invention.

FIG. 4 illustrates an axial fan assembly 100 including a shroud 104, a motor 108 coupled to the shroud 104, and an axial fan 112 coupled to and driven by the motor 108. Particularly, as shown in FIG. 4, the motor 108 includes an output shaft (not shown) for driving the axial fan 112 about a central axis 116 of the axial fan 112. In the illustrated embodiment, the shroud 104 is a molded, one-piece part.

The axial fan assembly 100 is configured to be coupled to the heat exchanger in a "draw-through" configuration, such that the axial fan 112 draws an airflow through the heat exchanger. Alternatively, the axial fan assembly 100 may be coupled to the heat exchanger in a "push-through" configuration, such that the axial fan 112 discharges an airflow through the heat exchanger. Any of a number of different connectors may be utilized to couple the axial fan assembly 100 to the heat exchanger.

In the illustrated construction of the axial fan assembly 100 of FIG. 4, the shroud 104 includes a mount 120 upon which the motor 108 is coupled. The mount 120 is coupled to the outer portions of the shroud 104 by a plurality of canted vanes or motor stators 124, which redirect the airflow discharged by the axial fan 112.

Figure 5A:
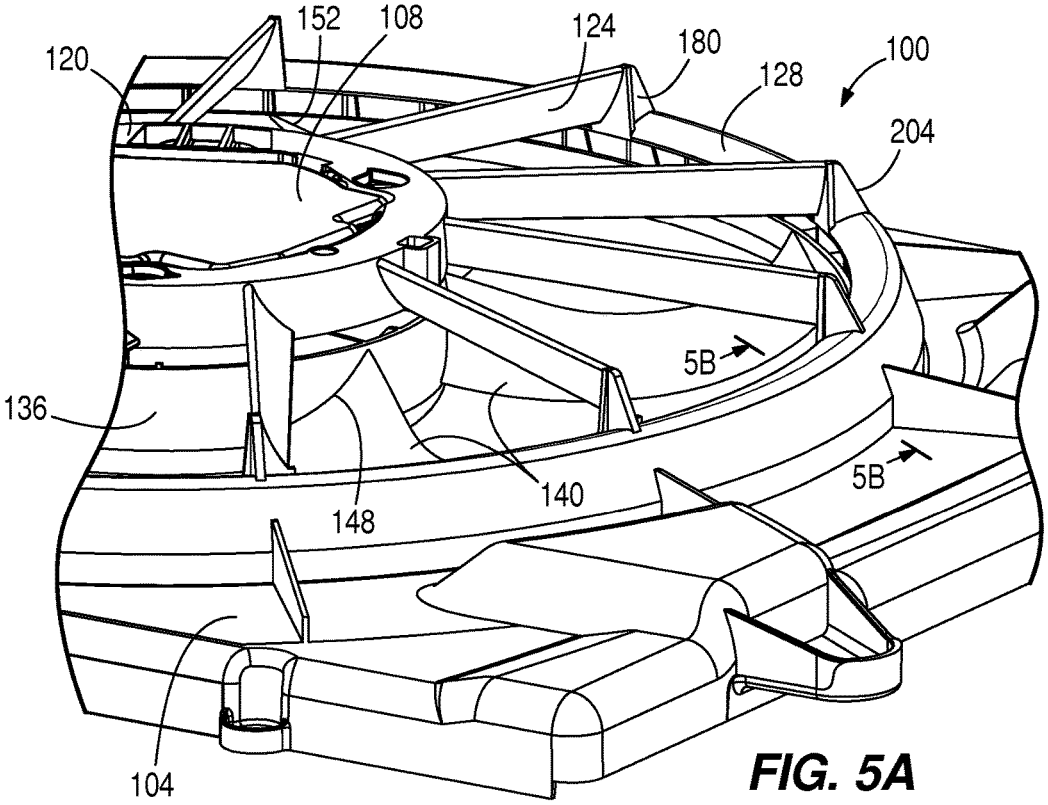
FIG. 5A is a partial perspective view of the axial fan assembly of FIG. 4, illustrating the shroud, the motor coupled to the shroud, and the axial fan driven by the motor.
Figure 5B:
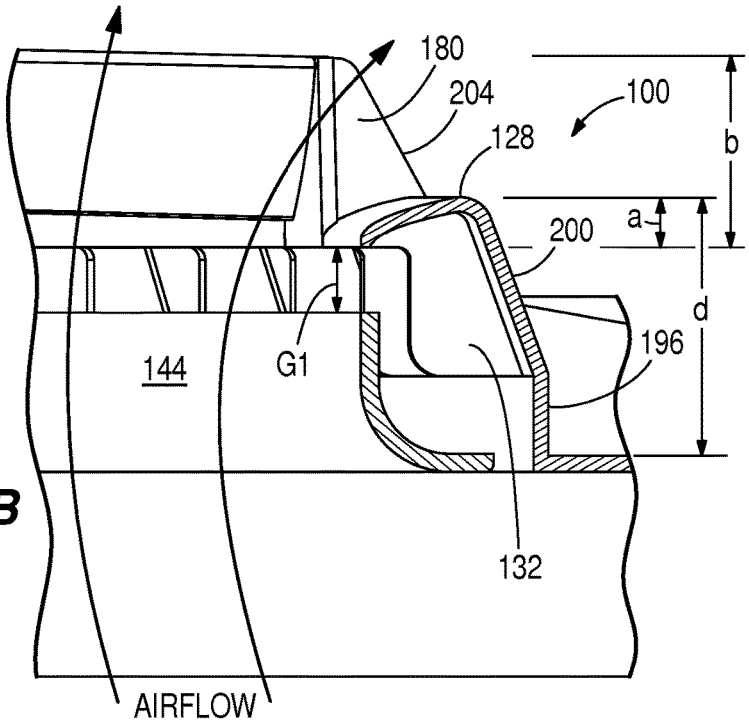
FIG. 5B is a partial section view of the shroud and fan band of FIG. 5A.
Figure 6:
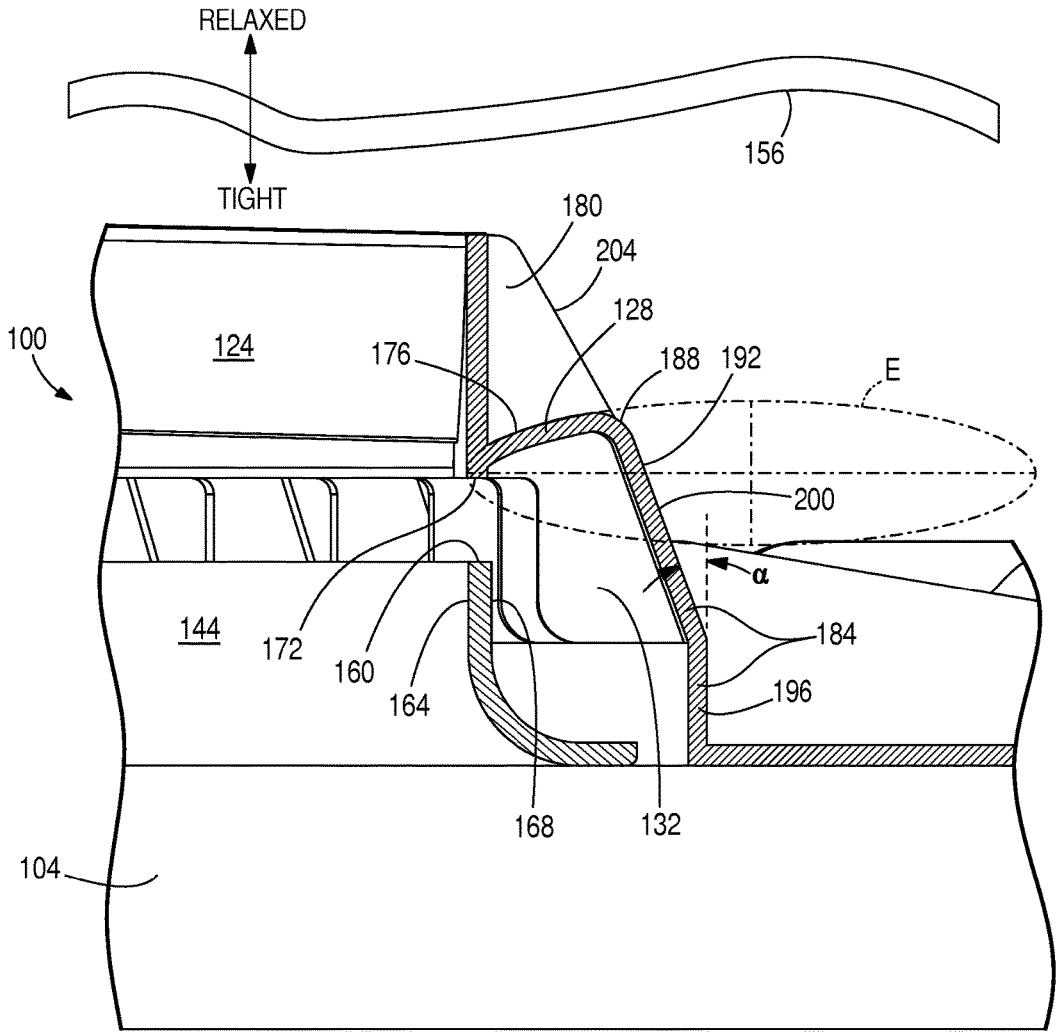
FIG. 6 is another partial section view of the shroud and fan band of FIG. 5A illustrating a downstream blockage spaced from the axial fan.

Referring now to FIGS. 5-6, the shroud 104 also includes a substantially annular outlet bell 128 positioned around the outer periphery of the axial fan 112. A plurality of leakage stators 132 are coupled to the outlet bell 128 and are arranged about the central axis 116. During operation of the axial fan 112, the leakage stators 132 reduce recirculation around the outer periphery of the axial fan 112 by disrupting or decreasing the tangential component of the recirculating airflow (i.e., the "pre-swirl").

The axial fan 112 includes a central hub 136, a plurality of blades 140 extending outwardly from the hub 136, and a band 144 connecting the blades 140. Particularly, each blade 140 includes a root portion or a root 148 adjacent and coupled to the hub 136, and a tip portion or a tip 152 spaced outwardly from the root 148 and coupled to the band 144.

With reference to FIG. 6, the axial fan assembly 100 is shown positioned relative to a schematically-illustrated downstream "blockage" 156. Such a blockage 156 may be a portion of the automobile engine, for example. Downstream blockage 156 can be referred to as "tight" if it constricts the fan wake. This occurs when the net cross sectional area of streamlines in the fan's wake is less than the area occupied by the fan blades in the fan plane. On the other hand, downstream blockage 156 can be referred to as "relaxed" if the wake's cross-sectional area is significantly larger than the fan blade area. The efficiency of the axial fan assembly 100 is dependent in part upon the spacing of the band 144 from the outlet bell 128 and the leakage stators 132, and upon the spacing between the outlet bell 128 and the blockage 156. Additionally, the shroud's stiffness, material cost, and package volume are additional factors that contribute to the overall desirability of the axial fan assembly 100.

FIGS. 5B and 6 illustrate the spacing between the band 144 and the outlet bell 128 and the leakage stators 132 in one construction of the axial fan assembly 100. Particularly, the band 144 includes an end surface 160 adjacent an axially-extending, radially-inner surface 164 and an axially-extending, radially-outer surface 168. The outlet bell 128 includes an end surface 172 adjacent a radially-inner surface or downstream surface 176. An axial gap "G1" (see FIG. 5B) is measured between the respective end surfaces 160, 172 of the band 144 and the outlet bell 128. The end surfaces 160, 172 of the band 144 and the outlet bell 128 are generally aligned in the radial direction, such that there is virtually no radial offset between the radially-inner surface 164 of the band 144 and the radially-inner surface 176 of the outlet bell 128 at the end surfaces 160, 172. The axial gap G1 is relatively large to provide running clearances. This allows for good fan efficiency when the downstream blockage 156 is relaxed, that fan efficiency being improved under the same blockage conditions as the prior art fan assemblies 10 and 60.

Another improvement is realized by virtue of the shape/geometry of the outlet bell 128. As illustrated in FIG. 6, the radially-inner surface 176 of the outlet bell 128 is configured in a shape that defines a portion of an ellipse E, which has its minor axis in the axial direction of airflow through the fan assembly 100. As illustrated in FIG. 6, the radially-inner surface 176 conforms to a portion of an ellipse E having its minor axis parallel to the axial airflow direction and parallel to the central axis 116. In other embodiments, the radially-inner surface 176 could conform to a portion of an ellipse having its minor axis non-parallel to the central axis 116, but still extending generally in the direction of airflow. Such a partial elliptical shape to the outlet bell 128, in which the axial length of the outlet bell 128 is reduced as compared to the prior art fan assemblies 40, and 60, reduces the volume occupied by the outlet bell 128 and the leakage stators 132 within. Reduced volume reduces the material costs of the shroud 104. Furthermore, the reduced axial depth of the outlet bell 128 due to this partial elliptical shape reduces the restriction of the fan wake in the presence of tight downstream blockage, improving fan efficiency in that condition.

Yet another improvement is realized by virtue of the partial elliptical shape of the outlet bell's radially-inner surface 176. This partial elliptical shape provides an aspect ratio in which the outlet bell's cross section has a smaller overall length in the axial airflow direction and a larger overall length in the radial direction. This aspect ratio provides for a solid structural base for the motor stator pedestals 180, which in the illustrated embodiment are the generally triangularly-shaped components that interconnect the motor stators 124 to the outlet bell 128. This solid base provided by the outlet bell 128 improves the stiffness of the shroud 104, especially over that of the fan assembly 10 and despite its comparable material mass and package volume.

Yet another improvement is realized by virtue of the configuration of the barrel 184 of the shroud 104, and is illustrated clearly in FIG. 6. The barrel 184 is the annular portion of the shroud 104 that extends axially away from (in the downstream direction) the planar body of the shroud 104, before reaching a furthest downstream point where an apex 188 is formed at the intersection of the barrel 184 and the outlet bell 128. A radially-outer surface 192 of the barrel 184 faces radially away from the fan 112 and the motor 108 until it transitions into the radially-inner surface 176 of the outlet bell 128 (which faces entirely radially inwardly toward the motor 108) at the apex 188. The wall portion of the barrel 184 that defines the radially-outer surface 192 includes a first, upstream segment 196 that extends parallel to the central axis 116 to form a cylindrical shape about the central axis 116, and a second, downstream segment 200 that is angled radially inwardly from the first segment 196 at an angle $\alpha$ of between 15 degrees and 35 degrees to form a highly conical shape about the central axis 116. This highly conical barrel segment 200 reduces the volume occupied by the leakage stators 132 to the minimum needed for them to perform the task of retarding leakage flow around the fan band 144. This further reduces the material cost and packaging volume in the vehicle. FIGS. 5B and 6 further illustrate how radially-outer surfaces 204 of the stator pedestals 180 are generally aligned with and have generally the same slope as the radially-outer surface 192 at the conical segment 200. These outer surfaces 204 can also form an angle with the first segment 196 of between 15 degrees and 35 degrees. This again facilitates the improved stiffness and packaging volume of the shroud 104.

Certain modifications to the illustrated design can be made without deviating from the invention. For example, in some embodiments, the shape of the outlet bell may not be that of a partial ellipse, but rather may take another form in which the outlet bell's cross section has a smaller overall length in the axial airflow direction and a larger overall length in the radial direction. While the partial ellipse geometry is generally a good arrangement for turning the flow outwardly because the curvature becomes smaller as the boundary layer grows, other geometries can also prove beneficial. In the case of an elliptical shape as shown in FIG. 6, or in the case of other forms, FIG. 5B illustrates a relationship that provides the advantages discussed above. Specifically, the overall depth "a" of the outlet bell 128 is less than ½ the depth "b" from the tips of the stator pedestals 180 to the bottom of the outlet bell 128. Furthermore, while the stator pedestals are shown as being triangular in shape, other, non-triangular shapes can be used while still fulfilling the same function of transferring load from the pedestals to the outlet bell and leakage stators.

An analytical comparison of the shroud 104 with the prior art shroud designs has shown reduced axial deflection (due to increased stiffness) as compared to all prior art designs upon application of a 200 N force, a volume that is reduced versus all but one of the prior art designs, and a total mass that is reduced from all but one of the prior art designs.

Various features and advantages of the invention are set forth in the following claims.

What is claimed is:

1. A fan shroud for an axial-flow fan, the fan shroud comprising:

a motor mount;

a plurality of motor stators coupling the motor mount to a radially outer portion of the shroud;

an annular barrel extending axially away from the radially outer portion of the shroud, the annular barrel including a cylindrical segment and a conical segment downstream of the cylindrical segment, the conical segment being angled radially inwardly from the cylindrical segment at an angle of between 15 degrees and 35 degrees; and an annular outlet bell coupled to the conical segment of the annular barrel at an apex defining a transition between the conical segment and the outlet bell, the outlet bell and barrel containing a plurality of circumferentially-spaced leakage stators therein for disrupting or decreasing a tangential component of airflow within the outlet bell and barrel;

wherein each of the plurality of motor stators is coupled to the outlet bell by a stator pedestal extending from a radially-inner surface of the outlet bell to a stator pedestal tip, and wherein a depth (a) of the outlet bell measured from an end surface of the outlet bell to the apex in a direction of axial airflow through the fan shroud is less than one-half a depth (b) measured from the end surface of the outlet bell to the stator tip in the direction of axial airflow through the fan shroud.

2. The fan shroud of claim 1, wherein the radially-inner surface of the outlet bell defines a portion of an ellipse.

3. The fan shroud of claim 2, wherein the stator pedestals are generally triangular in shape.

4. The fan shroud of claim 3, wherein each stator pedestal includes a radially-outer surface that forms an angle with the cylindrical segment of between 15 degrees and 35 degrees.

5. The fan shroud of claim 2, wherein the radially-inner surface of the outlet bell defines a portion of an ellipse that has a minor axis extending parallel to the direction of axial airflow through the fan shroud.

6. The fan shroud of claim 1, wherein the depth (a) of the outlet bell is smaller than a cross-sectional length of the outlet bell measured in a radial direction normal to the direction of axial airflow through the fan shroud.

7. The fan shroud of claim 6, wherein the stator pedestals are generally triangular in shape.

8. The fan shroud of claim 7, wherein each stator pedestal includes a radially-outer surface that forms an angle with the cylindrical segment of between 15 degrees and 35 degrees.

9. The fan shroud of claim 1, wherein the stator pedestals are generally triangular in shape.

10. The fan shroud of claim 9, wherein each stator pedestal includes a radially-outer surface that forms an angle with the cylindrical segment of between 15 degrees and 35 degrees.

11. An axial fan assembly comprising:

an axial fan including a hub;

a plurality of blades extending outwardly from the hub; and a band interconnecting tip portions of the plurality of the blades, the band having a radially-inner surface, a radially-outer surface, and an end surface adjacent to and extending between the radially-inner surface and the radially-outer surface;

a motor drivingly connected to the axial fan; and a fan shroud including a motor mount supporting the motor;

a plurality of motor stators coupling the motor mount to a radially outer portion of the shroud;

an annular barrel extending axially away from the radially outer portion of the shroud, the annular barrel including a cylindrical segment and a conical segment downstream of the cylindrical segment, the conical segment being angled radially inwardly from the cylindrical segment at an angle of between 15 degrees and 35 degrees; and an annular outlet bell coupled to the conical segment of the annular barrel at an apex defining a transition between the conical segment and the outlet bell, the outlet bell and barrel containing a plurality of circumferentially-spaced leakage stators therein for disrupting or decreasing a tangential component of airflow within the outlet bell and barrel;

wherein each of the plurality of motor stators is coupled to the outlet bell by a stator pedestal extending from a radially-inner surface of the outlet bell to a stator pedestal tip, and wherein a depth (a) of the outlet bell measured from an end surface of the outlet bell to the apex in a direction of axial airflow through the fan shroud is less than one-half a depth (b) measured from the end surface of the outlet bell to the stator tip in the direction of axial airflow through the fan shroud; and wherein an axial gap G1 is provided between the end surface of the band and the end surface of the outlet bell, and wherein the end surface of the band and the end surface of the outlet bell are aligned in a radial direction.

12. The axial fan assembly of claim 11, wherein the radially-inner surface of the outlet bell defines a portion of an ellipse.

13. The axial fan assembly of claim 12, wherein the stator pedestals are generally triangular in shape.

14. The axial fan assembly of claim 13, wherein each stator pedestal includes a radially-outer surface that forms an angle with the cylindrical segment of between 15 degrees and 35 degrees.

15. The axial fan assembly of claim 12, wherein the radially-inner surface of the outlet bell defines a portion of an ellipse that has a minor axis extending parallel to the direction of axial airflow through the fan shroud.

16. The axial fan assembly of claim 11, wherein the depth (a) of the outlet bell is smaller than a cross-sectional length of the outlet bell measured in a radial direction normal to the direction of axial airflow through the fan shroud.

17. The axial fan assembly of claim 16, wherein the stator pedestals are generally triangular in shape.

18. The axial fan assembly of claim 17, wherein each stator pedestal includes a radially-outer surface that forms an angle with the cylindrical segment of between 15 degrees and 35 degrees.

19. The axial fan assembly of claim 11, wherein the stator pedestals are generally triangular in shape.

20. The axial fan assembly of claim 19, wherein each stator pedestal includes a radially-outer surface that forms an angle with the cylindrical segment of between 15 degrees and 35 degrees.

* * * * *